US006095199A

United States Patent [19]

Jacobsson

[11] Patent Number: 6,095,199

[45] Date of Patent: Aug. 1, 2000

[54] YARN FEEDER INCLUDING AN ADJUSTABLE CARRIER RING FOR VARYING BRAKING EFFECTS

[75] Inventor: Kurt Arne Gunnar Jacobsson, Ulricehamn, Sweden

[73] Assignee: IRO AB, Ulriceham, Sweden

[21] Appl. No.: 09/142,441

[22] PCT Filed: Mar. 12, 1997

[86] PCT No.: PCT/EP97/01277

§ 371 Date: Apr. 29, 1999

§ 102(e) Date: Apr. 29, 1999

[87] PCT Pub. No.: WO97/34035

PCT Pub. Date: Sep. 18, 1997

[30] Foreign Application Priority Data

Mar. 13, 1996 [DE] Germany ..... 196 09 871

[51] Int. Cl.[7] ..... D03D 47/34; B65H 51/22

[52] U.S. Cl. ..... 139/452; 242/365.4

[58] Field of Search ..... 139/452; 242/365.4

[56] References Cited

U.S. PATENT DOCUMENTS 5,181,544 1/1993 Deiuri .
5,553,641 9/1996 Zenoni ..... 139/452
5,778,943 7/1998 Tholander ..... 139/452

FOREIGN PATENT DOCUMENTS 0 446 447 A1 9/1991 European Pat. Off. .
0 536 088 A1 4/1993 European Pat. Off. .
0 652 312 A1 5/1995 European Pat. Off. .
0 707 102 A2 4/1996 European Pat. Off. .
WO 95/20700 8/1995 WIPO .

*Primary Examiner*—Andy Falik
*Attorney, Agent, or Firm*—Flynn, Thiel, Boutell & Tanis, P.C.

[57] ABSTRACT

A yarn feeder having a storage drum, a bracket fixed to the housing and a controlled yarn withdrawal brake axially displaceably held in the bracket. The yarn withdrawal brake includes a ring-shaped braking body co-operating with a yarn withdrawal region of the storage drum and further includes an outer carrier ring which is displaceable in the axial direction within a predetermined axial clearance defined in a ring-shaped holder. The predetermined axial clearance is defined by axial counter stops, and the holder includes at least one pair of shift drives which act on the carrier ring from opposite directions. At least one side surface of the carrier ring is provided with at least one group of travel stroke adjustment ramps of different axial heights, each of which ramps can be selectively aligned with an axial counter stop of the holder.

19 Claims, 3 Drawing Sheets

YARN FEEDER INCLUDING AN ADJUSTABLE CARRIER RING FOR VARYING BRAKING EFFECTS

FIELD OF THE INVENTION

The present invention relates to a yarn feeder including a housing and a storage drum supported thereon, and a yarn withdrawal brake having a carrier ring which is axially shiftable within a predetermined clearance to vary braking effects on the yarn as same is withdrawn from the storage drum.

BACKGROUND OF THE INVENTION

In a yarn feeder of this kind as known from WO95/20700, the carrier ring can be moved reciprocally by means of shift drives forwards and backwards exclusively over one and the same travel stroke within the axial clearance in the holder. Since the holder can be adjusted in the bracket in the axial direction, the braking effect between the braking body and the yarn withdrawal region of the storage drum can also be adjusted, either when the carrier ring abuts at an axial counter stop or the carrier ring abuts the opposite axial counter stop. However, the travel stroke of the carrier ring cannot be varied by this adjustment, i.e. the difference between the braking effect in both abutting positions. It is disclosed to adjust the travel stroke of the carrier ring between its axial counter stops of the holder by inserting or removing disc washers from an axial counter stop intended for one moving direction of the carrier ring in the housing. However, this is time-consuming and necessitates a partial disassembly in the region of the holder.

It is an object of the invention to improve a yarn feeder of this kind such that the travel stroke of the carrier ring within the predetermined axial clearance in the holder can be varied comfortably and rapidly in order to vary the difference between the braking effects in both end positions of the carrier ring in addition to the already possible adjustment of the holder.

The above object can be achieved by providing a yarn feeder with a carrier ring which is axially shiftable in a ring-shaped holder within a predetermined clearance defined by counter stops of the holder. Further, at least one pair of shift drives are provided on the holder for axially shifting the carrier ring between the counter stops, and the carrier ring defines thereon at least one travel stroke adjustment ramp for adjusting the stroke of the carrier ring within the predetermined clearance. The carrier ring is rotatable relative to holder so as to align the ramp with a first of the counter stops which faces the ramp facing counter stop.

By rotating the carrier ring in said holder, the travel stroke of the carrier ring can be varied simply and rapidly between its end positions, since the first axial counter stop of the holder is then in a co-operating position.

In one embodiment, an additional axial counter stop is provided, which also co-operates with a travel stroke adjustment ramp in order to create another adjustment possibility for the travel stroke of the carrier ring in the holder.

According to another embodiment, the axial side surface of the carrier ring or the plane of the axial side surface of the carrier ring may itself form a travel stroke adjustment ramp within the ramp group.

Several travel stroke adjustment ramp groups may be distributed over the circumference of the carrier ring in order to guarantee a stable support of the carrier ring.

A particularly advantageous embodiment includes housings located at a removal opening of the holder, which housings form the first axial counter stop which may be selectively brought into co-operation with the travel stroke adjustment ramps of each group.

In another embodiment, at both axial side surfaces of the carrier ring, groups of travel stroke adjustment ramps are provided, and groups of counter stops are provided at both axial sides of the holder. In this way, a plurality of adjustment possibilities for the travel stroke of the carrier ring are achieved.

In yet another embodiment, three travel stroke adjustment ramps are provided which satisfy in practice all requirements regarding the variation of the travel stroke of the carrier ring.

In still another embodiment, the carrier ring can be comfortably rotated in order to vary the travel stroke via inclined transition surfaces provided between the respective ramps. The inclined transition surfaces in addition produce clearly grippable movement transitions.

Rotational limiting abutments prevent an excessive rotational adjustment of the carrier ring.

In a further embodiment, the co-operation between each axial counter stop and one travel stroke adjustment ramp takes place at a location circumferentially offset relative to the shifting drive.

In a still further embodiment, the first axial counter stop is located in the region of the shift drive. In the case where the travel stroke adjustment ramps are provided at the axial side of the carrier ring facing the first axial counter stop a receiving cut-out follows or is located adjacent the first axial counter stop. The receiving cut-out occasionally acts as a further axial counter stop, allowing the co-operation between the first axial counter stop and a lower travel stroke adjustment ramp, since a higher travel stroke adjustment ramp is able to enter the receiving cut-out.

In an alternative embodiment, the shift element of the shift drive itself forms the first axial counter stop of the holder, which first axial counter stop co-operates with the carrier ring or the travel stroke adjustment ramps, respectively.

In another embodiment, the shift elements loading the carrier ring in a direction towards a weak braking engagement or release position are actuated pneumatically or magnetically only upon demand, while the shift element acting in the opposite direction is effective permanently.

In yet another embodiment, both shift drives of a pair are pneumatical or magnetic shift drives which preferably are actuated actively and selectively in both shift directions.

The carrier ring according to the invention may be formed of plastic and the travel stroke adjustment ramps integral therewith. This embodiment is simple in terms of manufacturing. The groups of travel stroke adjustment ramps can be formed with only a few structural molding steps.

In one embodiment, markings are provided so as to visually display the selected travel stroke.

Also a projection may be provided to assist in rotation of the carrier ring.

In another embodiment, the carrier ring equipped with the travel stroke adjustment ramps is provided on a braking body fulfilling the braking effect by means of resilient bristles, fingers, lamellae or by means of a resilient annular membrane having a brake lining. The basic braking effect can be set by means of the axial displacement device of the holder in the bracket. The travel stroke of the carrier ring in the holder due to the travel stroke adjustment ramps is variable, such that the difference between the braking effects in both end positions of the carrier ring can be varied.

BRIEF DESCRIPTION OF THE DRAWINGS

Embodiments of the invention will be described with reference to the drawings, in which.

DETAILED DESCRIPTION

Figure 2:
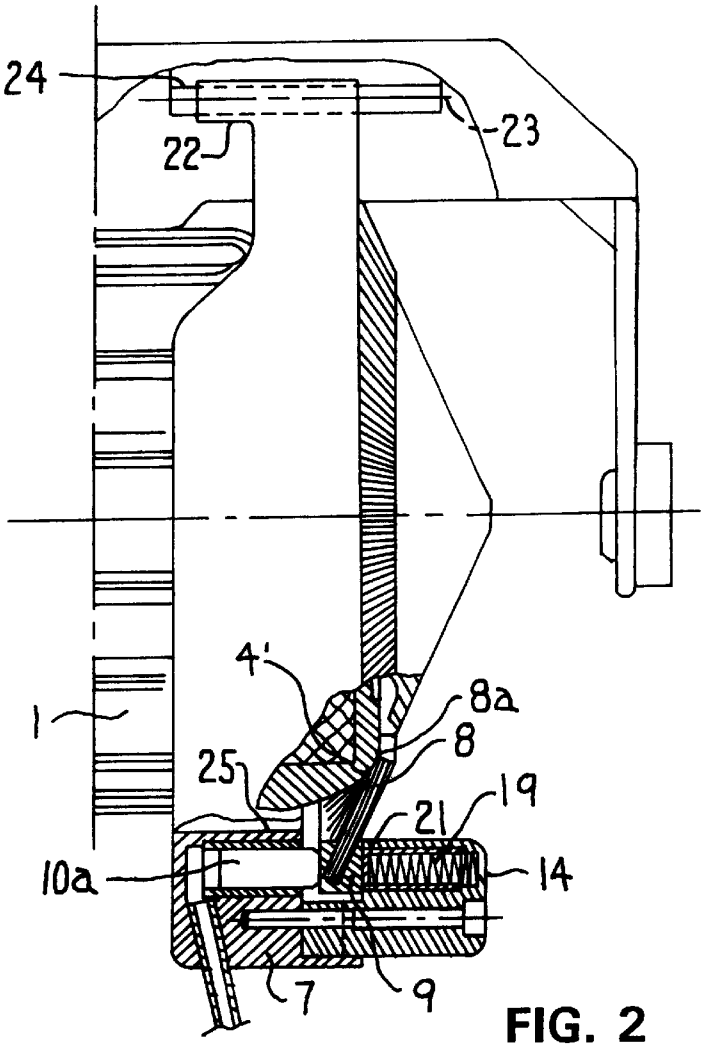
FIG. 2 is an illustration similar to the illustration of FIG. 1, showing the yarn withdrawal brake in a weaker braking or release position.
Figure 1:
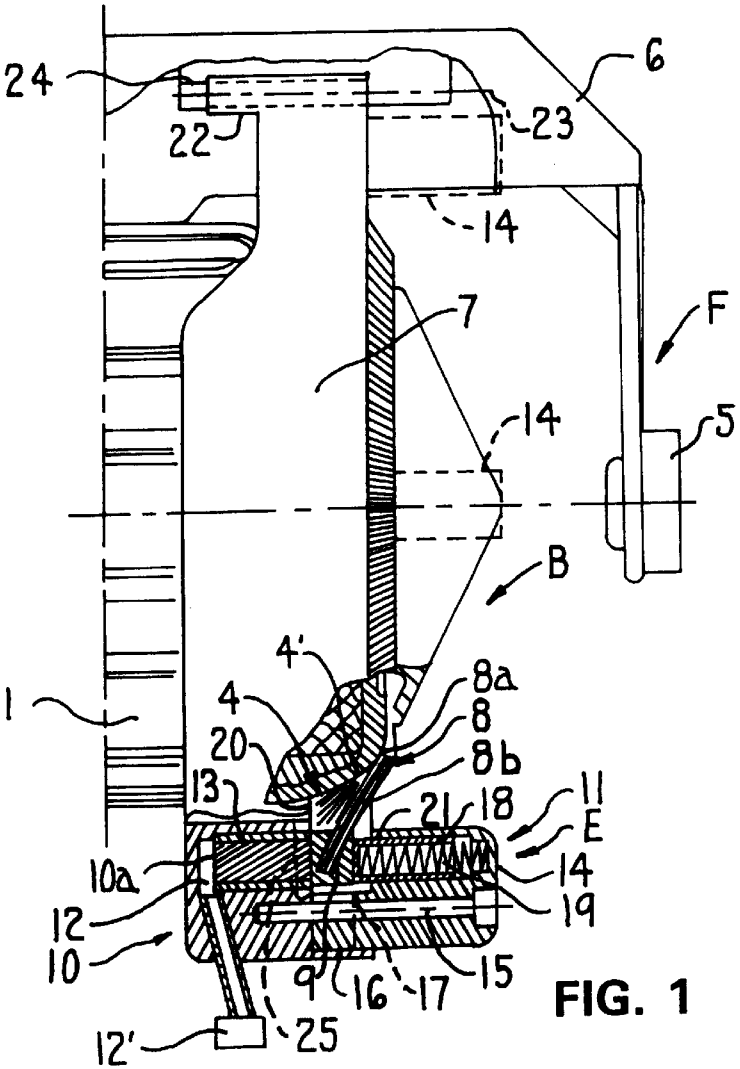
FIG. 1 shows a fragmentary side view of a yarn feeder, in partial cross-section, having a controlled yarn withdrawal brake shown in a braking position.

In FIG. 1 and 2 only the right hand end part of a yarn feeder F is shown. Said yarn feeder also has a housing with a drive motor (not shown) and a support for a storage drum 1. A controllable yarn withdrawal brake B is associated to the front end of storage drum 1. Said brake B is located in a bracket 6 fixed to said housing and extending outside and alongside of storage drum 1. Guides 24 intended for a sleigh 22 are provided in said bracket 6. Said sleigh 22 can be adjusted by means of an adjustment spindle or screw 23 parallel to the axis of storage drum 1. Said bracket 6 furthermore carries a yarn eyelet 5 for the yarn (not shown) which is withdrawn overhead of the drum end and through the withdrawal brake from a yarn store formed by windings on storage drum 1.

An annular holder 7 is connected with sleigh 22. Said holder 7 receives a ring shaped and conical braking body 8 which is insertable in FIG. 1 from the right-hand side through a removal opening E into holder 7. Said braking body 8 includes an outer continuous carrier ring 9, preferably with a square cross section, and (in this embodiment) obliquely inwardly pointing bristles or bristle bundles, the inner ends of which define a braking region 8*a* and which are supported via a flexible middle region 8*b* at carrier ring 9. Said inner ends conventionally co-operate with a braking zone 4' situated at a yarn withdrawal region 4 of storage drum 1 in order to brake the yarn which is orbiting around the drum during withdrawal. Holder 7 includes several pairs of shift drives 10, 11 distributed along its circumference. By means of said shift drives 10, 11 the carrier ring 9 can be adjusted forwards and backwards within an axial clearance provided between axial counter stops 20, 21 of holder 7 and in a direction parallel to the axis of storage drum 1, in order to vary the braking effect occurring between the braking area 8*a* and the braking zone 4'. For example, the axial counter stop 20 is defined by a radial surface of holder 7. The opposite axial counter stop 21 is formed by the end surface of several housings 14, each of which is rotatably provided in a turn receiver or receiving element 16 of holder 7 such that it can be rotated between an engagement position (FIG. 1–3) and a release position (indicated in FIG. 3 by dotted lines) about the axis of a fixing screw 15.

Figure 3:
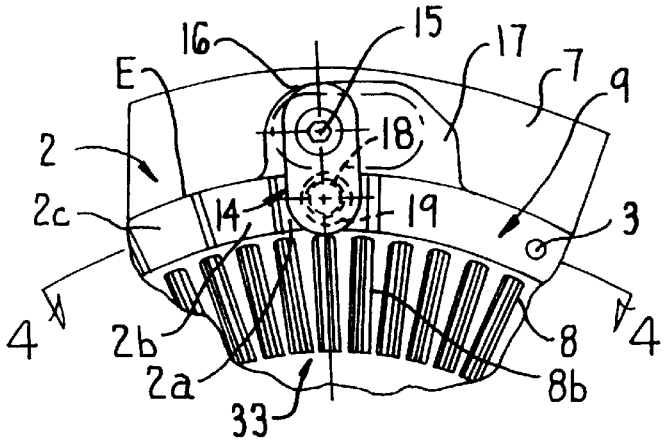
FIG. 3 shows a fragmentary front view of the yarn feeder from the right side in FIGS. 1 and 2.

In the embodiment of FIG. 1–3, each shift drive 10 is a pneumatical shift drive having a piston 10*a* located in a chamber 12 lined by a bushing 13, said chamber being connected with a pressure medium control 12'. Each shift drive 11 includes a bushing 18 loaded in housing 14 by a return spring 19. The bushing 18 and the piston 10*a* form shift elements which directly engage at carrier ring 9 and which shift carrier ring 9 within the axial clearance provided between the axial counter stops 20, 21 forwards and backwards. Instead of bushing 18 and the permanently effective return spring 19 in each shift drive 11, a piston could be provided which is selectively actuable by pressure from a control unit. A supporting surface 17 is provided in a turn receiver 16 for said bushing 18. Each axial counter stop 20 could be bounded in circumferential direction to the area of the shift drive 10, such that the carrier ring can be caught at four axial counter stops distributed in circumferential directions. Between said counter stops 20 receiving cut-outs 25 may be formed, the purpose of which will be described further below.

In FIG. 1, pistons 10*a* are not being actuated pneumatically. By means of return spring 19 and bushing 18, carrier ring 9 is held at the axial counter stops 20. This corresponds to the position intended for a forceful braking effect, which e.g. can be adjusted by means of the adjustment spindle or screw 23.

In FIG. 2 pistons 10*a* are actuated by air pressure and are extended such that the carrier ring 9 is caught at the opposite axial counter stops 21. This corresponds to the position for a weaker braking effect or a release position, with low or no contact pressure of said braking area 8*a* against the braking zone 4' of said storage drum 1.

The yarn feeder F with the controlled withdrawal brake B preferably can be employed with gripper or projectile weaving machines for feeding the weft yarn in order to vary the braking effect during each pick by controlling the withdrawal brake B. The actuation of pistons 10*a* is, for example, carried out depending upon the operational cycle of the associated weaving machine.

In FIG. 3 it can be seen that, after pivoting housing 14 in receiver 16 into the dash dotted position, said carrier ring 9 can be removed from holder 7. Furthermore, housing 14, in the engagement position, grips from the outside inwardly and over the carrier ring in order to support same. At carrier ring 9 a rotation assist 3, e.g. a pin, can be provided which is accessible by hand in the mounting position of the braking body 8 and allows the carrier ring to rotate relative to holder 7. Furthermore, at the axial side surface of carrier ring 9 as shown in FIG. 3, a group 2 of several travel stroke adjustment ramps 2*a*, 2*b* and 2*c* of different relative heights is provided, of which each travel stroke adjustment ramp can be selectively aligned with the axial counter stop 21 formed by housing 14. By selecting the appropriate travel stroke adjustment ramp 2*a*, 2*b* or 2*c*, the travel stroke of the carrier ring within the axial clearance in holder 7 can be varied, particularly in the embodiment according to FIG. 3, such that the carrier ring 9 depending on the selection one of the travel stroke adjustment ramps 2*a*, 2*b* or 2*c* in its weak braking or release position will be located a greater or lesser distance from axial counter stop 20. In this way, the difference between both braking positions of the controlled yarn withdrawal brake B can be varied by a rotational adjustment movement of carrier ring 9 in holder 7. Braking body 8 as shown in FIG. 3 is a so-called straw or bristle braking ring equipped with bristles 33. Instead of bristles 33, resilient fingers or plastic or steel lamellae can be anchored in carrier ring 9.

Figure 4:
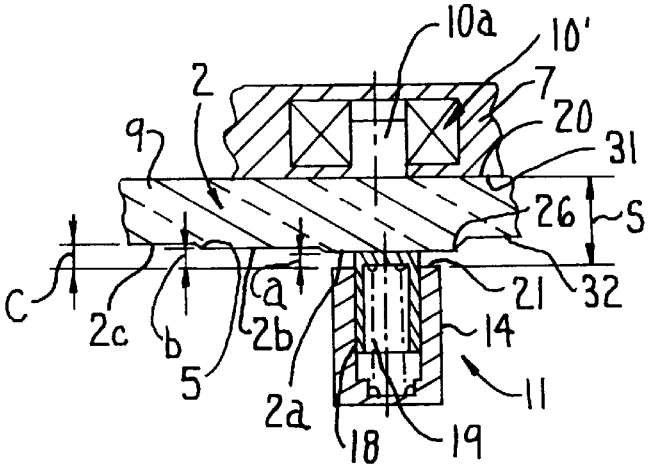
FIG. 4 shows a cross-sectional view taken generally along line 4—4 in FIG. 3.

FIG. 4 is a cross-sectional view taken along line 4—4 of FIG. 3 that incorporates a magnetic shift drive 10' in place of the pneumatic shift drive of FIG. 1 and 2. Shift drive 10' includes a magnet armature 10*a'* and an actuating solenoid 10' in holder 7, while shift drive 11 corresponds with shift drive 11 in FIG. 1 received by housing 14. Carrier ring 9 is built with two axial side surfaces 31 and 32. Axial side surface 31 is even and co-operates with axial counter stop 20 of holder 7. Groups 2 of travel stroke adjustment ramps 2*a,* 2*b* and 2*c* of different heights are provided at axial side surface 32 in a circumferentially offset manner and in alignment with housings 14. Travel stroke adjustment ramp 2*c* in this case is located in the radial plane of the axial side surface 32. Travel stroke adjustment ramp 2*b* protrudes slightly beyond axial side surface 32. Travel stroke adjustment ramp 2*a* protrudes even further beyond axial side surface 32. Between said travel stroke adjustment ramps 2*a,* 2*b* and 2*c* inclined or rounded transition surfaces 5 are provided. Furthermore, at the end of the first and last travel stroke adjustment ramps 2*a* and 2*c,* respectively of said group 2 rotation limiting abutments 26 are formed which prevent excessive rotation of the carrier ring (i.e. or limit rotation of the carrier ring 9). Of carrier stroke adjustment ramps 2*a,* 2*b* and 2*c,* only one of such ramps cooperates with axial counter stop 21. In case that travel stroke adjustment ramp 2*a* is aligned with axial counter stop 21, the travel stroke of the carrier ring 9 within the axial clearance S between axial counter stops 20 and 21 has a magnitude (a). When travel stroke adjustment ramp 2*b* is aligned with said axial counter stop 21, then the magnitude of the travel stroke of carrier ring 9 is (b). Finally, if travel stroke adjustment ramp 2*c* is aligned with axial counter stop 21, the magnitude of the travel stroke of the carrier ring 9 is (c). Moreover, the shift drive 11 in FIG. 4 as well could be a magnetic shift drive according to the shift drive as shown in the upper part of FIG. 4.

Figure 5:
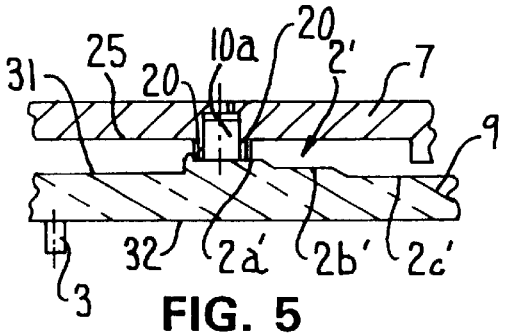
FIG. 5 and FIG. 6 show fragmentary cross-sectional views similar to the view of FIG. 4 of variations of the carrier ring.

FIG. 5 is a sectional view similar to FIG. 4 of another embodiment in which the carrier ring 9 is equipped with several groups 2' of travel stroke adjustment ramps 2*a',* 2*b'* and 2*c',* corresponding with the number of axial counter stops 20 at the axial side surface 31 facing the piston 10*a* of holder 7. In group 2' again three travel stroke adjustment ramps of different heights are shown, one of which coincides with the axial side surface 31. In the rotational direction of carrier ring 9 relative to holder 7, receiving cut-outs 25 follow the axial counter stop 20 in which receiving cut-outs 25 the higher travel stroke adjustment ramps 2*a',* 2*b'* can enter in case that the axial counter stop 20 is co-operating with the lowest travel stroke adjustment ramp 2*c'*. At the other axial side surface 32 of carrier ring 9 no travel stroke adjustment ramps are provided. However, said axial side surface 32 is equipped with a turning assist, e.g. a projection or a pin 3, by means of which the carrier ring 9 may be easily rotated in holder 7. In each group, at least two travel stroke adjustment ramps should be provided with different heights. It is also possible to provide more than three travel stroke adjustment ramps with different heights.

Figure 6:
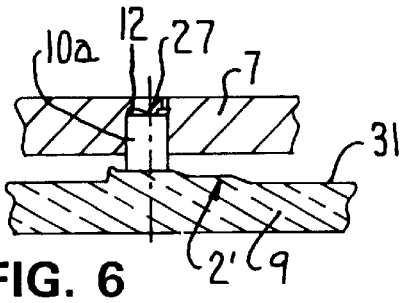

In the embodiment according to FIG. 6 at the axial side surface 31 of carrier ring 9 the group 2' consisting of several travel stroke adjustment ramps of different heights is formed. The axial counter stop of holder 7 in this case is formed by the shifting element itself, i.e. the piston 10*a,* which can be caught in a retracted position in chamber 12 at an abutment 27 such that it nevertheless projects far enough beyond holder 7 in order to be able to co-operate even with the lowest travel stroke adjustment ramp of said group 2'.

Figure 7:
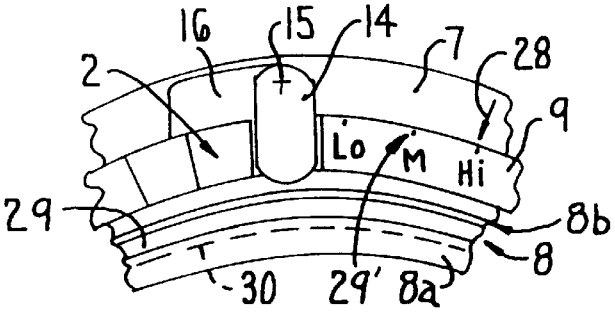
FIG. 7 shows a schematic fragmentary front view similar to FIG. 3 of an alternative embodiment.

According to FIG. 7 the braking body 8 including said carrier ring 9 is an essentially frustoconical rubber membrane 29, defining the resilient middle portion 8*b* of the braking body 8, and carrying as braking area 8*a* a brakelining 30 (indicated in dotted lines) which is formed as a frustoconical coated band of steel or a wear proof metal alloy bonded to rubber membrane 29 such that the brakelining 30 co-operates with brake zone 4' of storage drum 1. Furthermore, in FIG. 7 it is stressed that at carrier ring 9 and holder 7, markings 28 and 29' are provided, which can be aligned with another, in order to visually show which travel stroke has been selected by the selection of the respective travel stroke adjustment ramp of group 2.

Figure 8:
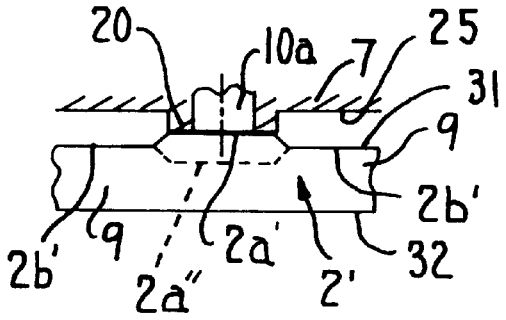
FIGS. 8–11 show fragmentary views, in partial cross-section, of additional variants of the carrier ring.

In the embodiment of FIG. 8, which is similar to the embodiment of FIG. 5, in group 2' on the axial side surface 31 of carrier ring 9 two travel stroke adjustment ramps 2*a'* and 2*b'* of different heights are provided, which can be selectively aligned with axial counter stop 20 provided in the region of the shift drive or the shift element (piston 10*a*) at holder 7. Counter stop 20 is bordered in the rotational direction of carrier ring 9 by receiving cut-outs 25. Occasionally, travel stroke adjustment ramp 2*a'* co-operates with a surface as defined by the receiving cut-out 25 in a position rotated in comparison to FIG. 8 by one step. At 2*a"* it is indicated in dotted lines that a travel stroke adjustment ramp might even be set back in relation to axial side surface 31. A similar configuration of the travel stroke adjustment ramp could (alternatively or additively) be provided at the other axial side surface of carrier ring and for co-operation with the other axial counter stop 21.

Figure 9:
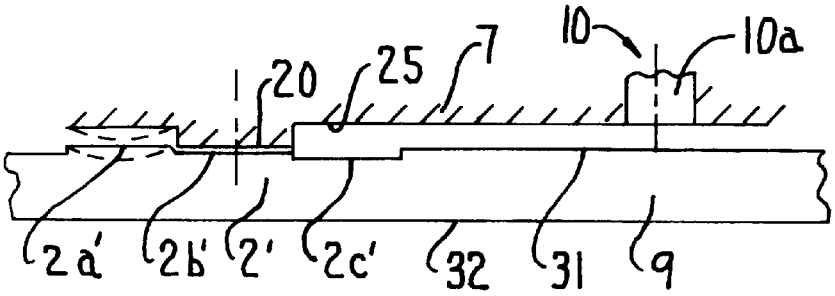

In the embodiment of FIG. 9, the shift drive 10 or the piston 10*a* is offset in the circumferential direction of holder 7 in relation to axial counter stop 20, such that the co-operation between said axial counter stop and each one of the travel stroke adjustment ramps 2*a',* 2*b'* and 2*c'* of group 2' does not take place in the region of shift drive 10. The intermediate travel stroke adjustment ramp 2*b'* is located in the plane of the axial side surface 31; travel stroke adjustment ramp 2*c'* is set back in relation to the axial side surface 31; and travel stroke adjustment ramp 2*a'* projects beyond axial side surface 31. Axial counter stop 20 is bounded or bordered at both sides by receiving cut-outs 25. In dotted lines it is indicated that said travel stroke adjustment ramps (particularly here travel stroke adjustment ramp 2*a'*) are not necessarily formed as planar surfaces, but could also be convexly rounded or differently structured with a profile in order to achieve a certain centering effect by the co-operation of the surface shapes. As in the preceding embodiments, however, shift drive 10 also could also be located in the region of axial counter stop 20.

Figure 10:
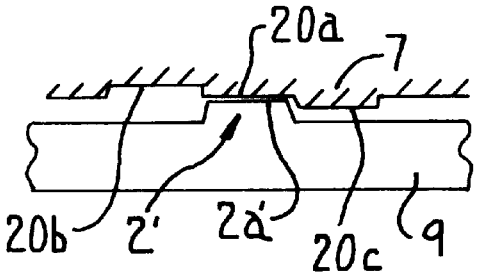

In the embodiment of FIG. 10, at carrier ring 9 only one elevated travel stroke adjustment ramp 2*a'* of group 2' is provided. On the contrary, in holder 7 three axial counter stops 20*a,* 20*b* and 20*c* of different heights are formed with which the travel stroke adjustment ramp 2*a'* can selectively be brought into co-operation. The associated shift drive could be located in the region of the axial counter stops or could be offset in circumferential direction.

Figure 11:
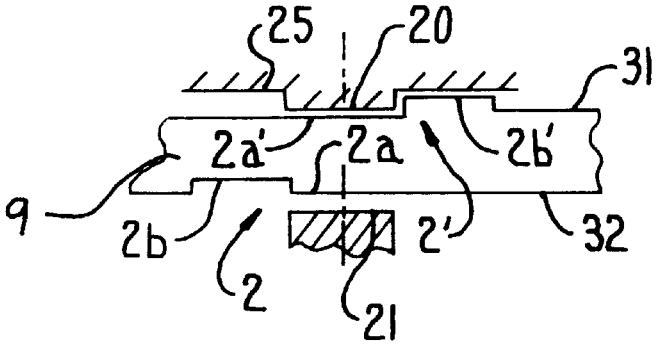

The embodiment of FIG. 11 has at each axial side surface of carrier ring 9 two travel stroke adjustment ramps 2*a',* 2*b'* in group 2' and 2*a,* 2*b* in group 2. The axial counter stops 20 and 21 each cooperate with independent travel stroke adjustment ramps on the respective side surfaces of carrier ring 9, such that the travel stroke of the carrier ring within the given axial clearance between that counter stop 20 and 21 cannot only be varied, but said travel stroke can even be shifted in both directions within said axial clearance.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A yarn feeder comprising:

a housing;

a storage drum supported on said housing and defining an axis;

a controlled yarn withdrawal brake axially adjustably supported on said housing and including a ring-shaped braking body and a ring-shaped holder associated therewith, said braking body cooperating with a yarn withdrawal region of said storage drum and having a carrier ring, said carrier ring being axially shiftable within said holder within a predetermined clearance defined axially between a pair of counter stops defined on said holder;

a pair of opposed shift drives disposed on said holder which are respectively engageable with said carrier ring from opposite axial directions for axially shifting said carrier ring between said counter stops; and said carrier ring having a side surface and at least one travel stroke adjustment ramp disposed on said side surface for adjusting a travel stroke of said carrier ring within said predetermined clearance, said ramp defining a surface which is axially offset relative to said side surface, and said carrier ring being rotatable relative to said holder to align said ramp with one of said counter stops facing said side surface of said carrier ring.

2. The yarn feeder of claim 1 wherein an additional counter stop is defined on said holder generally circumferentially adjacent said one counter stop, said additional counter stop defining a surface which either projects axially beyond, or is axially inset relative to, a surface defined on said one counter stop.

3. The yarn feeder of claim 2 wherein said one counter stop and said additional counter stop are both circumferentially offset relative to one of said shift drives.

4. The yarn feeder of claim 1 wherein said side surface of said carrier ring is a first side surface and said carrier ring includes a second side surface facing away from said first side surface, a plurality of pairs of said shift drives and a plurality of pairs of said counter stops are distributed about the circumference of said holder, each said pair of counter stops including a first counter stop facing said first side surface of said carrier ring and a second counter stop facing said second side surface of said carrier ring, said first side surface defining thereon a plurality of groups of said ramps, said ramp groups being circumferentially spaced from one another about said carrier ring, each said ramp group being circumferentially spaced from an adjacent said ramp group by a distance which generally corresponds to a circumferential distance defined between the respective said first counter stops, the number of said ramp groups defined on said carrier ring corresponding to the number of said first counter stops provided on said holder.

5. The yarn feeder of claim 4 further including a bracket fixed to said housing, said braking body includes a plurality of resilient and elongate braking elements which project inwardly from said carrier ring, said braking elements having inner ends which define a braking region, said braking body being adjustable to vary the braking effect thereof via an adjustment device provided on said bracket.

6. The yarn feeder of claim 4 further including a bracket fixed to said housing, said braking body includes an elastic annular membrane having a frustoconical ring-shaped brake lining which defines a braking region, said braking body being adjustable to vary the braking effect thereof via an adjustment device provided on said bracket.

7. The yarn feeder of claim 4 wherein said holder defines a carrier ring removal opening at a side thereof adjacent the yarn withdrawal region of said drum and along an edge of said removal opening a plurality of drive housings are disposed, each said drive housing mounting thereon a drive element of each said pair of shift drives, each said drive housing being mounted on said holder such that said drive housing is pivotably movable between an engagement position in which said drive housing at least partially overlaps said removal opening and said carrier ring and a release position removal opening and said carrier ring and a release position in which said drive housing clears said removal opening and said carrier ring, each said drive housing defining thereon a said first counter stop which faces said ramp groups and limits axial movement of said carrier ring in said engagement position of said drive housing.

8. The yarn feeder of claim 1 wherein said side surface of said carrier ring is a first side surface and said carrier ring defines thereon a second side surface facing away from said first side surface, each said first and second side surface defining thereon a plurality of groups of said ramps which are distributed circumferentially along said carrier ring, said ramp groups being circumferentially spaced from one another about said carrier ring, a plurality of pairs of said counter stops are provided along the circumference of said holder, each said pair of counter stops including a first counter stop facing said first side surface of said carrier ring for cooperation with said first side surface ramp groups, and a second counter stop facing said second side surface of said carrier ring for cooperation with said second side surface ramp groups.

9. The yarn feeder of claim 1 wherein said side surface of said carrier ring defines thereon a plurality of groups of said ramps, said ramp groups being circumferentially spaced from one another about said carrier ring, each said ramp group including at least three of said ramps having differing height dimensions defined generally parallel to the drum axis.

10. The yarn feeder of claim 9 wherein an inclined transition surface is defined between adjacent pairs of ramps of each said ramp group.

11. The yarn feeder of claim 9 wherein a rotation limiting abutment is provided adjacent a first and a last one of said ramps of at least one of said ramp groups to limit rotation of said carrier ring relative to said holder.

12. The yarn feeder of claim 1 wherein said ramp is a first ramp and additional ramps are provided on said side surface circumferentially adjacent said first ramp, said first ramp and said additional ramps having differing height dimensions defined generally parallel to the drum axis, one of said additional ramps is defined by said side surface of said carrier ring.

13. The yarn feeder of claim 1 wherein said holder includes a generally axially oriented opening in which one of said shift drives is movably disposed, said one counter stop is a stop surface which defines a mouth of said opening, and a receiving cut-out is defined in said holder circumferentially adjacent said stop surface.

14. The yarn feeder of claim 1 wherein said ramp is a first ramp and additional ramps are provided on said side surface of said carrier ring circumferentially adjacent said first ramp, said first ramp and said additional ramps having differing height dimensions defined generally parallel to the drum axis, one of said shift drives includes a shift element movably disposed in a generally axially oriented opening defined in said holder, said shift element having a first portion disposed within said opening and a second portion defining thereon said one counter stop at a free end thereof, wherein when said shift element is in a retracted position within said opening said second portion projects axially outwardly of said opening by a distance sufficient to allow cooperation of said one counter stop with the ramp having the smallest height dimension.

15. The yarn feeder of claim 1 wherein one of said shift drives of said pair of shift drives which engages said carrier ring and shifts same towards a brake release position comprises either a pneumatic shift drive having a piston or a magnetic shift drive having a magnetic armature, and the other said shift drive of said pair of shift drives includes a shift element which is biased toward said carrier ring by either a spring or a permanent magnet.

16. The yarn feeder of claim 1 wherein both of said shift drives of said pair of shift drives comprise either pneumatic shift drives including pistons or magnetic shift drives having magnetic armatures.

17. The yarn feeder of claim 1 wherein said carrier ring is constructed of plastic and said ramp is an integral and monolithic component thereof.

18. The yarn feeder of claim 1 wherein markings are disposed on said carrier ring and said holder which are registrable with one another upon rotation of said carrier ring to enable visual recognition of the relative positions of said ramp and said one counter stop.

19. The yarn feeder of claim 1 wherein a projection is disposed on said carrier ring to assist in rotating said carrier ring relative to said holder.

* * * * *